US005094421A

United States Patent [19]

Zaccone

[11] Patent Number: 5,094,421

[45] Date of Patent: Mar. 10, 1992

[54] CORNER HANGER

[76] Inventor: Samuel G. Zaccone, 1315 N. 13th Ave., Melrose Park, Ill. 60160

[21] Appl. No.: 608,984

[22] Filed: Nov. 5, 1990

[51] Int. Cl.[5] ..... A47G 1/00

[52] U.S. Cl. ..... 248/493; 248/495; 248/297.3

[58] Field of Search ..... 248/493, 220.1, 497, 248/498, 489, 495, 297.3, 243, 339

[56] References Cited

U.S. PATENT DOCUMENTS

| | | | |
|---|---|---|---|
| 317,906 | 5/1885 | Williams | 211/87 X |
| 325,196 | 8/1885 | Caldwell | 211/87 |
| 505,230 | 9/1893 | Robinson | 248/220.1 |
| 1,219,025 | 3/1917 | Mertz | 248/220.1 |
| 1,703,872 | 3/1979 | Engleson | 248/300 X |
| 2,478,256 | 8/1949 | Gysmann | 248/498 |
| 3,578,205 | 5/1971 | Ballester | 248/220.1 X |
| 4,083,458 | 4/1978 | Young, Jr. | 248/220.1 X |

*Primary Examiner*—Alvin C. Chin-Shue
*Attorney, Agent, or Firm*—Edmond T. Patnaude

[57] ABSTRACT

A first bracket, which includes a base plate and side flanges which lie against the walls of a room near a corner thereof, has slots in the base plate which receive tongues on the end of a second bracket which has spaced slots in the top edge thereof for receiving a hanger wire extending across the back of a picture frame for hanging the picture frame on the second bracket.

2 Claims, 1 Drawing Sheet

CORNER HANGER

The present invention relates in general to hangers such as used to hang pictures on a wall, and it relates in particular to a new and improved hanger for use in hanging picture frames or other articles such as loud speakers in the corners of rooms.

BACKGROUND OF THE INVENTION

When decorating rooms it is frequently desirable to hang a picture in a corner of a room. One hanger which may be used for this purpose is disclosed in U.S. Pat. No. 505,230, that hanger being visible from the front of the picture. It would be desirable, however, to provide a hanger which is located entirely behind the picture so as to be hidden from view. Also, it would be disirable that the hanger be usable with all different sizes of pictures.

SUMMARY OF THE INVENTION

Briefly, there is provided in accordance with the present invention a two part hanger which includes a first bracket which attaches to the walls of a room in a corner thereof and a second bracket which is attached to the first bracket and extends outwardly from the first bracket midway between the two walls. One or more notches are provided in the top edge of the second bracket to receive a conventional hanger wire connected to the back of a picture frame or other device.

GENERAL DESCRIPTION OF THE DRAWING

Further objects and advantages and a better understanding of the invention may be had from a reading of the following detailed description taken in connection with the accompanying drawing wherein.

DETAILED DESCRIPTION OF A PREFERRED EMBODIMENT

Figure 1:
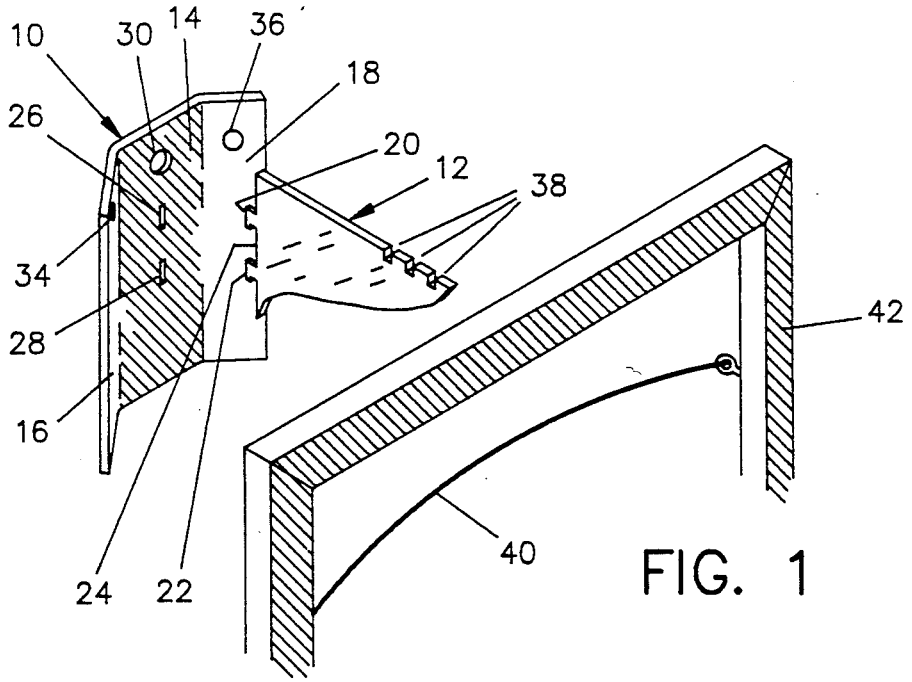
FIG. 1 is an exploded perspective view of a picture hanger embodying the present invention in use in hanging a picture in a corner of a room.

Referring to the drawings, the novel picture hanger or the present invention may be seen to include a first bracket 10, which is adapted to be mounted in the corner of a room, and a second bracket 12 which is removably attachable to the bracket 10. The bracket 10 includes a planar base plate section 14 and a pair of planar side flanges 16 and 18. The side flanges 16 and 18 extend at forty-five degree angles relative to the base portion 14.

Figure 2:
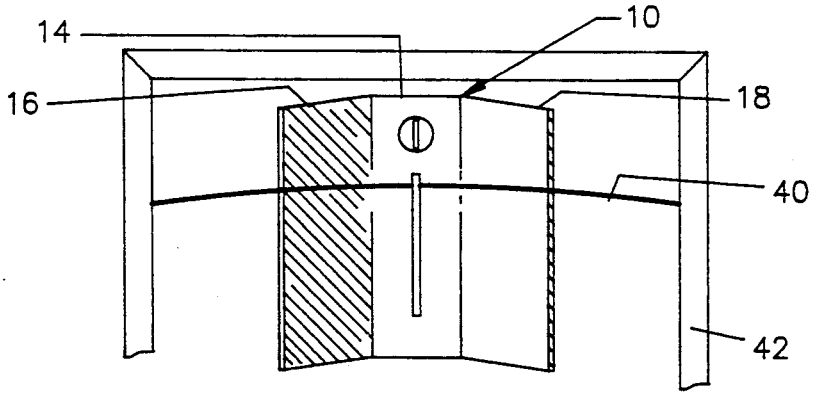
FIG. 2 is a front view of a picture frame hanging from the hanger of FIG. 1.

The bracket 12 is plate-like and includes two vertically spaced lugs 20 and 22 which extend from the end 24 thereof. The lugs 20 and 22 are adapted to be received in a pair of slots 26 and 28 located one above the other in the base portion 14 of the bracket 10. The lugs 20 and 22 each have a depending lower end portion which fits behind the base portion 10 when the brackets 10 and 12 are assembled together as shown in FIGS. 2 and 3 thereby to lock the bracket 12 to the bracket 10.

The bracket 10 has a through hole 30 in the base portion 14 for receiving a mounting screw 32 which is used to affix the bracket 10 to the walls of the room. Additional through holes 34 and 36 are respectively provided in the flanges 16 and 18 to receive additional mounting screws or nails for use in hanging relatively heavy pictures.

Figure 3:
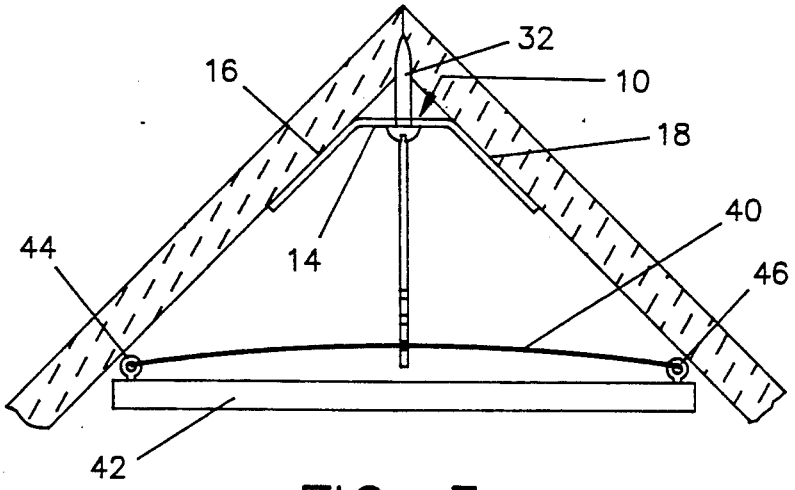
FIG. 3 is a horizontal cross-sectional view of the hanger and picture frame shown in FIG. 2.

As best shown in FIG. 1, a plurality of notches 38 are provided in the upper edge of the bracket 12 for receiving a conventional hanger wire 40 attached to the back of a picture frame 42 by a pair of eyebolts 44 and 46 as best shown in FIG. 3.

In use, the bracket 10 is first mounted to the walls of the room by means of the screw 32 or by any other suitable means with the flanges 16 and 18 lying flat against the associated walls. The bracket 12 is then attached to the bracket 10 so that the bracket 12 extends outwardly from the bracket 10 midway between the two walls. The picture frame 42 is then placed in the corner with the sides of the frame touching the walls, and the hanger wire 40 is draped over the bracket 12 and placed in a selected one of the notches 38 which retains the picture frame in the desired position tightly against the walls. The height of the picture or other article can be adjusted by changing the selected notch.

While the present invention has been described in connection with a particular embodiment thereof, it will be understood by those skilled in the art that many changes and modifications may be made without departing from the true spirit and scope of the invention. Therefore, it is intended by the appended claims to cover all such changes and modifications which come within the true spirit and scope of the present invention.

I claim:

1. A method of hanging a picture in a room having walls intersecting at a corner, comprising the steps of providing a first bracket having a base portion and first and second flanges extending from opposite sides thereof, said flanges having surfaces adapted to lie flat against respective ones of said walls with said base portion extending across said corner, providing a second bracket extending from said first bracket midway between said flanges and having a plurality of notches in the top thereof, securing a filament across the back of said picture, and inserting said filament into a selected one of said notches to hang said picture in said corner so that said picture completely overlies said first and second brackets and with opposite sides of said picture abutting said walls.

2. In combination, first and second mutually intersecting walls forming a corner, first bracket means having a base portion and first and second planar flanges extending from opposite sides thereof, said flanges lying against and parallel to said walls with said base portion extending across said corner, second bracket means extending from said first bracket means midway between said flanges and having a plurality of notches for receiving a filament, a picture having a filament connected at opposite ends thereof to the back of said picture near opposite side edges thereof, and said filament being disposed in one of said notches to support said picture from said first and second bracket means with said picture covering said first and second bracket means and with said side edges respectively abutting said walls.

* * * * *